US006637727B1

(12) United States Patent
Decker et al.

(10) Patent No.: US 6,637,727 B1
(45) Date of Patent: Oct. 28, 2003

(54) RAIL PULLER INCLUDING A CLAMPING BEAM AND TWO CLAMPING MEMBERS AND A METHOD THEREOF

(75) Inventors: Arnold F. Decker, Aurora, IL (US); Steven A. Held, Hillside, IL (US)

(73) Assignee: Templeton, Kenly & Co., Broadview, IL (US)

( * ) Notice: Subject to any disclaimer, the term of this patent is extended or adjusted under 35 U.S.C. 154(b) by 0 days.

(21) Appl. No.: 10/127,385

(22) Filed: Apr. 22, 2002

(51) Int. Cl.[7] ..... B65B 25/00

(52) U.S. Cl. ..... 254/228; 254/43; 104/7.2; 104/7.1; 29/252

(58) Field of Search ..... 254/43, 44, 228, 254/233; 29/252, 281.5, 468; 104/7.1, 7.2, 2, 9, 15

(56) References Cited

U.S. PATENT DOCUMENTS

| | | | | |
|---|---|---|---|---|
| 3,424,101 A | | 1/1969 | Striebel et al. | |
| 3,465,687 A | | 9/1969 | Kerns | |
| 3,635,164 A | | 1/1972 | Patton | |
| 3,670,912 A | * | 6/1972 | Dunbar | 414/420 |
| 3,731,635 A | | 5/1973 | Hambrick | |
| 4,176,777 A | | 12/1979 | Bommart | |
| 4,313,382 A | | 2/1982 | Bommart | |
| 4,320,708 A | | 3/1982 | Bommart | |
| 4,348,959 A | | 9/1982 | Bommart | |
| 4,399,753 A | | 8/1983 | Theurer et al. | |
| 4,421,034 A | * | 12/1983 | Allmer | 104/9 |
| 4,457,234 A | | 7/1984 | Theurer et al. | |
| 4,641,818 A | | 2/1987 | Bommart | |
| 4,929,816 A | * | 5/1990 | Theurer et al. | 219/53 |
| 4,983,801 A | | 1/1991 | Theurer et al. | |
| 5,136,140 A | | 8/1992 | Theurer et al. | |
| 5,270,514 A | | 12/1993 | Wechselberger et al. | |
| 5,295,440 A | | 3/1994 | Cleveland | |
| 5,575,416 A | | 11/1996 | Oellerer et al. | |

FOREIGN PATENT DOCUMENTS

| | | | |
|---|---|---|---|
| EP | 566941 A1 * | 10/1993 | E01B/29/46 |
| EP | 0 455 178 B1 | 12/1993 | |

* cited by examiner

*Primary Examiner*—S. Joseph Morano
*Assistant Examiner*—Frantz F. Jules
(74) *Attorney, Agent, or Firm*—Michael Best & Friedrich LLP

(57) ABSTRACT

A rail puller that applies tension to rail sections to reduce the gap between the ends of rail sections. The rail puller comprises a first clamp assembly and a second clamp assembly located at opposite ends of the rail puller. A clamping beam is coupled to the first clamp assembly and the second clamp assembly, and has a clamping cylinder that extends and retracts to adjust the length of the clamping beam. At least two pulling members are coupled to the first clamp assembly and the second clamp assembly, and each pulling member has a pulling cylinder that extends and retracts to adjust the length of the pulling member. The clamping cylinder extends to clamp the clamp assemblies to rail sections, and the pulling cylinders retract to draw the clamp assemblies toward one another and reduce the gap between the rail sections.

33 Claims, 7 Drawing Sheets

RAIL PULLER INCLUDING A CLAMPING BEAM AND TWO CLAMPING MEMBERS AND A METHOD THEREOF

FIELD OF THE INVENTION

This invention relates to rail pullers, and more particularly to hydraulic clamping rail pullers used to tension rails.

BACKGROUND OF THE INVENTION

Rail pullers are commonly used in railways to pull the ends of rail sections together. Rail sections are relatively long, and may be as long as one quarter mile. The rail sections are usually aligned linearly with a gap between the ends of the rail sections. The gap between the rail sections may be approximately 6 inches. The rail puller puts the rail sections in tension to reduce the gap between the rail sections. Once the rail sections are pulled together, the ends of the rail sections are welded together to form a continuous track.

Rail sections are relatively heavy, and the force required to pull rail sections together and reduce the gap between the rail section is relatively large. Some prior art rail pullers use rams or hydraulic cylinders to pull the rail sections together. The hydraulic cylinders needed to generate the relatively large force required to pull the rail sections together are relatively heavy and expensive. Two characteristics of hydraulic cylinders are the travel distance and the pull capacity of the cylinder. The travel distance is dependent upon the length of the cylinder, and determines the distance between the fully retracted cylinder to the fully extended cylinder. The pull capacity is related to the cross-sectional area of the cylinder, and determines the amount of force the cylinder can generate.

Rail pullers generally clamp the rail sections, and then pull the rail sections together. The force required to clamp the rail sections is significantly less than the force required to pull the rail sections together. In some prior art rail pullers, the same hydraulic cylinders are used to both clamp the rail sections and pull the rail sections together.

SUMMARY OF THE INVENTION

The rail puller embodying the invention applies tension to rail sections to reduce the gap between the ends of rail sections. The rail puller comprises a first clamp assembly at one end of the rail puller, and a second clamp assembly at the opposite end of the rail puller. An elongated clamping beam is coupled to the first clamp assembly and the second clamp assembly, and includes a clamping cylinder that is extendable and retractable to adjust the length of the clamping beam. Elongated pulling members are coupled to the first clamp assembly and the second clamp assembly, and each pulling member has a pulling cylinder that is extendable and retractable to adjust the length of the pulling member. The clamping cylinder extends to position and clamp the first clamp assembly and second clamp assembly to rail sections, and the pulling cylinders retract to draw the first clamp assembly and second clamp assembly toward one another and reduce the gap between the rail sections.

The rail puller minimizes the travel distance of hydraulic cylinders used to pull the rail sections together. The clamping cylinder extends to lengthen the clamping beam and clamp the clamp assemblies onto the rail sections. Once the rail sections have been clamped, the pulling cylinders retract to pull the rail sections together. The travel distance of the pulling cylinders is reduced because the clamping cylinder is used to clamp the rail sections. Since the travel distance of the pulling cylinders is reduced, the weight and cost of the pulling cylinders is also reduced.

The force required to position the clamp assemblies clamp the rail sections is significantly less than the force required to pull the rail sections together, and the pulling capacity of the clamping cylinder can be substantially less than the pulling capacity of the pulling cylinders. Additionally, a single clamping cylinder can be used to clamp the rail sections. Since the pulling capacity of the clamping cylinder can be less than the required pulling capacity of the pulling cylinders, the overall weight and cost of the rail puller can be minimized.

Figure 1:
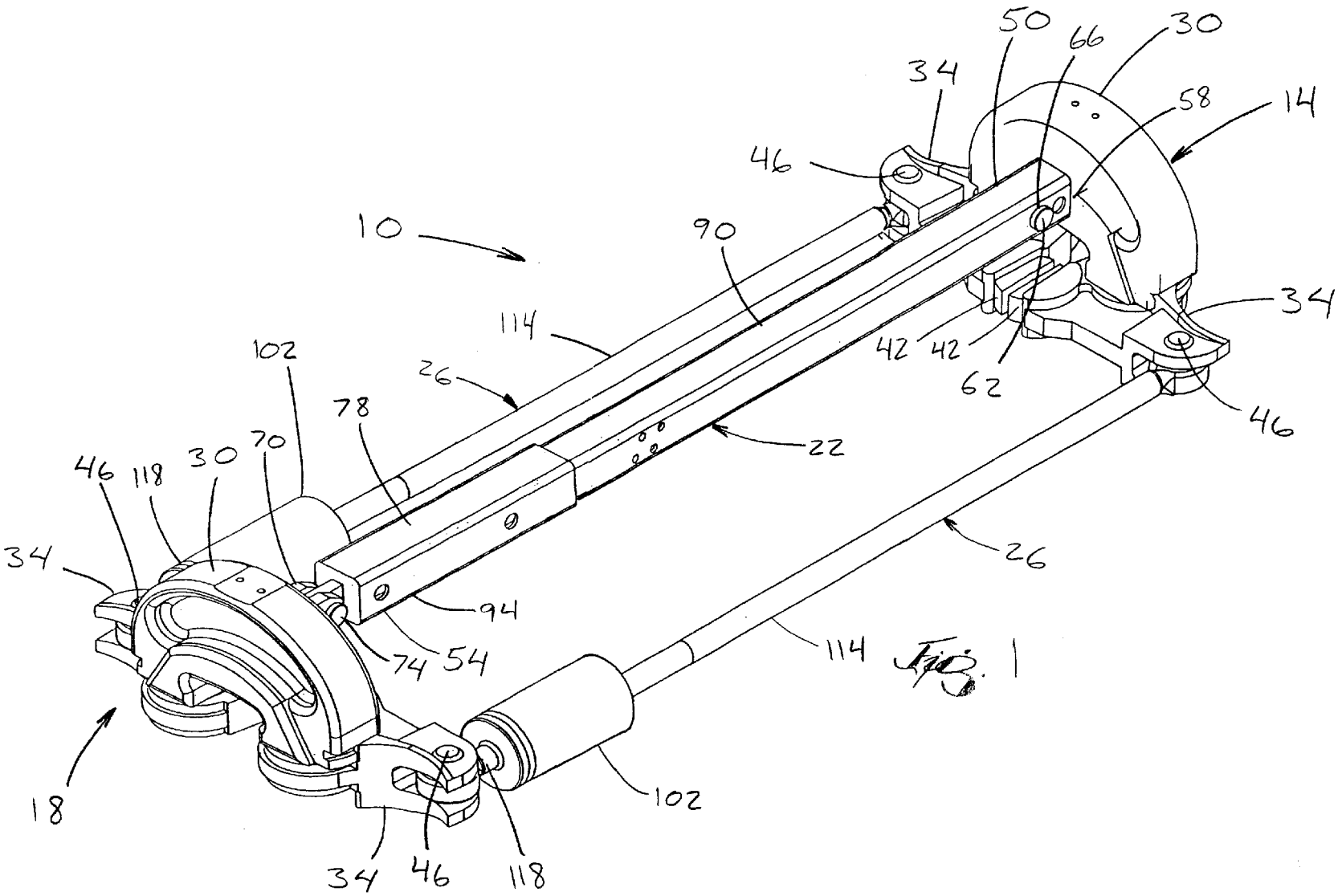
FIG. 1 is a perspective view of a rail puller embodying the invention.

Before the embodiments of the invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting.

Although references are made below to directions, such as left, right, up, down, top, bottom, front, rear, back etc., in describing the drawings, they are made relative to the drawings (as normally viewed) for convenience. These directions are not intended to be taken literally or limit the present invention in any form.

DETAILED DESCRIPTION

FIG. 1 illustrates a rail puller 10 for tensioning rails and reducing the gap between the ends of rail sections. The rail puller 10 generally has a longitudinal direction along its length and a lateral direction across its width. The rail puller 10 comprises a first clamp assembly 14 and a second clamp assembly 18 disposed at opposite ends of the rail puller 10. A clamping beam 22 and at least two pulling members 26 are coupled to the first and second clamp assemblies 14, 18. The clamping beam 22 extends longitudinally between the clamp assemblies 14, 18 near the middle of the rail puller 10, and the pulling members 26 extend longitudinally between the clamp assemblies 14, 18 along the sides of the rail puller 10 parallel and spaced apart from each other and from the clamping beam 22.

In the illustrated embodiment, the clamp assemblies 14, 18 are similar to each other, and each clamp assembly 14, 18 includes a clamp bracket 30 and two swing arms 34. The swing arms 34 are pivotally coupled to the clamp bracket 30 at inner joints 38. Each swing arm 34 has a grip 42 disposed longitudinally inwardly from the inner joint 38 near the inner side of the clamp assembly 14, 18 facing the opposing clamp assembly 14, 18. The grips 42 are pivotally coupled to the swing arms 34.

Figure 4:
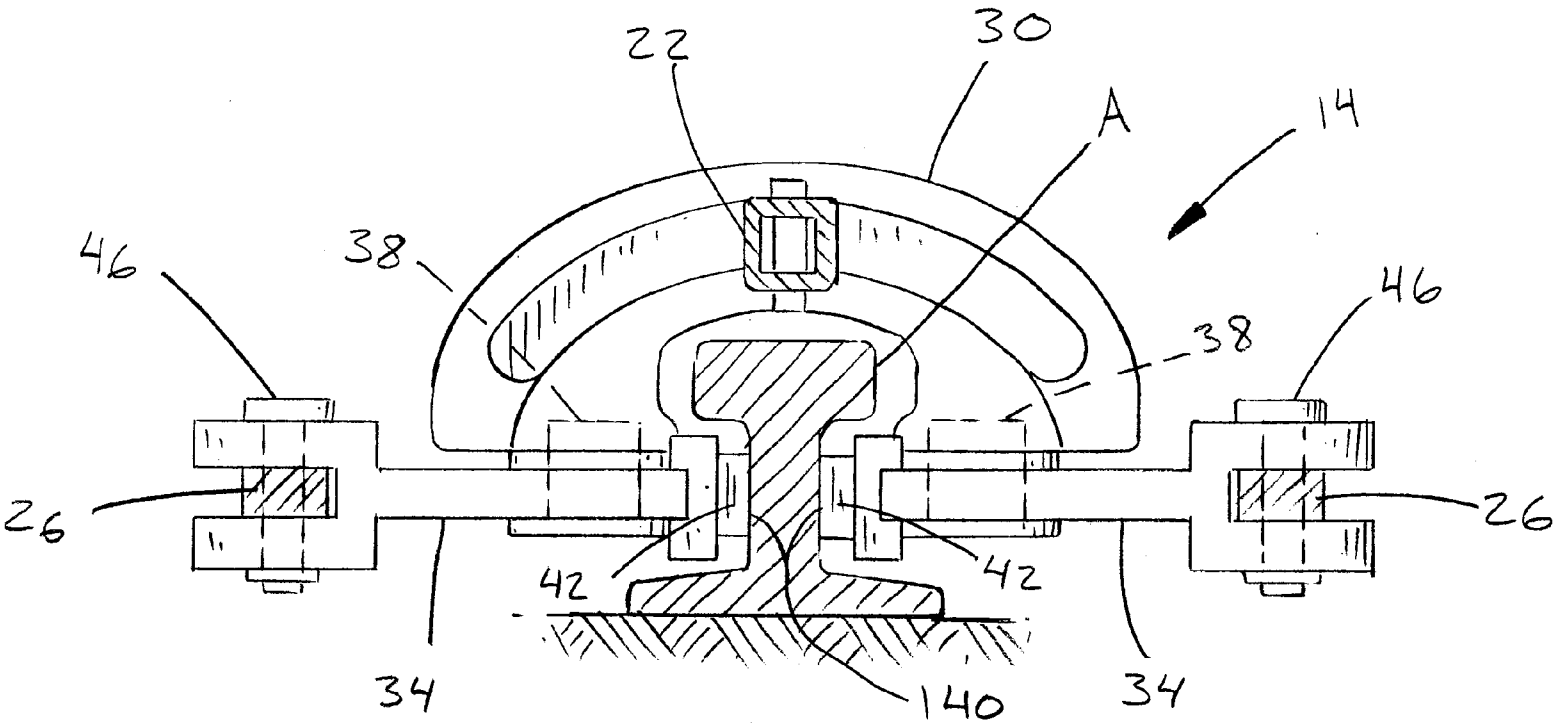
FIG. 4 is a cross-sectional view taken along line 4—4 of FIG. 3.

The clamping beam 22 is coupled to the clamp assemblies 14, 18 near the middle of the clamp brackets 30. The clamp brackets 30 generally extend in a lateral direction and are substantially transverse to the clamping beam 22. As shown in FIG. 4, the clamp brackets 30 are curved and generally C-shaped with the curved opening near the bottom portion of the clamp bracket 30 to provide clearance for a rail section A. The inner joints 38 coupling the clamp bracket 30 and the swing arms 34 are near the ends of the clamp bracket 30.

In FIG. 1, the pulling members 26 are coupled to the clamp assemblies 14, 18 near the outer ends of the swing arms 34. The pulling members 26 are pivotally coupled to the swing arms 34 at outer joints 46, which are disposed laterally outwardly from the inner joints 38. The swing arms 34 are generally triangular, with the inner joints 38, outer joints 46 and grips 42 as the corners of the triangle. Movement of the inner joints 38 or outer joints 46 causes the swing arms 34 to pivot and move the grips 42 toward or away from the rail.

The clamping beam 22 extends between the first clamp assembly 14 and the second clamp assembly 18. In the illustrated embodiment, the clamping beam 22 has a detachable end 50 that is removably coupled to the first clamp assembly 14, and a pivot end 54 that is pivotally coupled to the second clamp assembly 18. The detachable end 50 is removably coupled to a mounting bracket 58 on the first clamp assembly 14 with a lock pin 62. The detachable end 50 and the mounting bracket 58 have lock holes 66, and the lock pin 62 is inserted through the lock holes 66 to couple the clamping beam 22 to the first clamp assembly 14. The lock pin 62 is removed from the lock holes 66 to disconnect the clamping beam 22 from the first clamp assembly 14.

The pivot end 54 is pivotally coupled with a pivot pin 74 to a mounting bracket 70 on the second clamp assembly 18. When the detachable end 50 is disconnected from the first clamp assembly 14, the clamping beam 22 may be pivoted upwardly about the pivot pin 72. The clamping beam 22 may then be pivoted downwardly and the detachable end 50 reconnected to the first clamp assembly 14. As described below, the clamping beam 22 is pivoted to provide access to the rail sections and clearance within the rail puller 10. Alternatively, the detachable end 50 and pivot end 54 of the clamping beam 22 could be reversed with the detachable end 50 removably coupled to the second clamp assembly 18 and the pivot end 54 coupled to the first clamp assembly 14. Additionally, the clamping beam 22 could be rigidly attached to the first clamp assembly 14 and second clamp assembly 18 to prevent the clamping beam 22 from pivoting.

Figure 6:
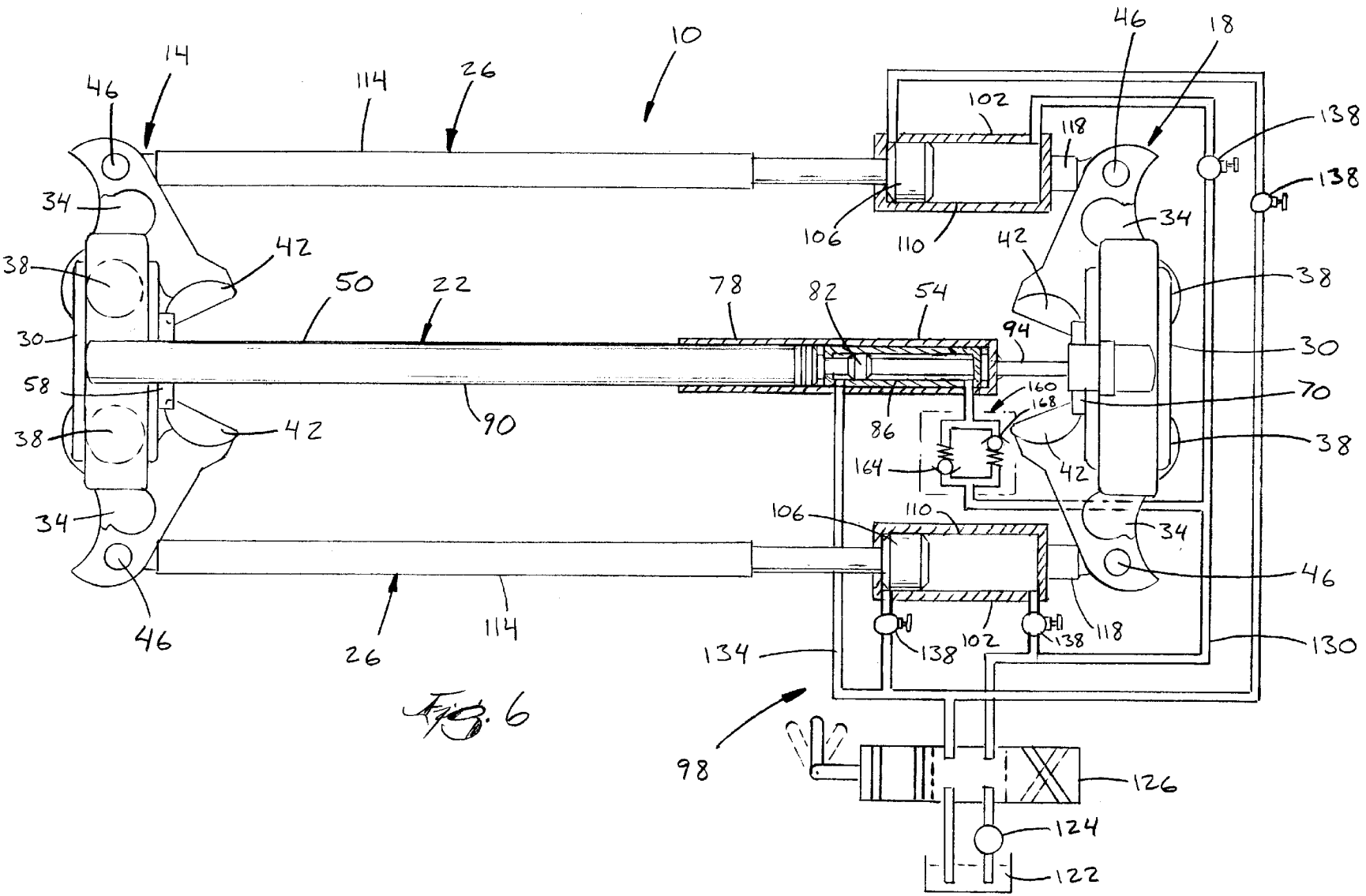
FIG. 6 is a plan view of the rail puller of FIG. 1, including a schematic of a hydraulic circuit.

The clamping beam 22 includes a clamping cylinder 78 that adjusts the length of the clamping beam 22. The clamping cylinder 78 extends to increase the length of the clamping beam 22, or retracts to decrease the length of the clamping beam 22. As shown in FIG. 6, the clamping cylinder 78 is a hydraulic cylinder and includes a piston 82 and a housing 86. A first portion 90 of the clamping beam 22 is interconnected to the piston 82 and a second portion 94 of the clamping beam 22 is interconnected to the housing 86. In FIG. 6, the detachable end 50 is interconnected to the first portion 90 and the piston 82, and the pivot end 54 is interconnected to the second portion 94 and the housing 86.

The piston 82 creates a seal with the housing 86, and a hydraulic circuit 98 provides hydraulic fluid to the clamping cylinder 78 to move the piston 82 in an extend direction or a retract direction with respect to the housing 86 to lengthen or shorten the clamping beam 22. The length of the clamping beam 22 determines the distance between the clamp brackets 30. Shortening the clamping beam 22 decreases the distance between the clamp brackets 30, and lengthening the clamping beam 22 increases the distance between the clamp brackets 30. As mentioned above, the swing arms 34 are coupled to the clamp brackets 30 at the inner joints 38.

In the illustrated embodiment, the pulling members 26 are similar to each other, and each pulling member 26 has a pulling cylinder 102 that adjusts the length of the pulling member 26. The pulling cylinders 102 extend to increase the length of the pulling members 26, or retract to decrease the length of the pulling members 26. As shown in FIG. 6, the pulling cylinders 102 are hydraulic cylinders, and each pulling cylinder 102 includes a piston 106 and a housing 110. A first portion 114 of the pulling member 26 is interconnected to the piston 106 and a second portion 118 of the pulling member 26 is interconnected to the housing 110. In the illustrated embodiment, the first portions 114 are interconnected to one of the swing arms 34 of the first clamp assembly 14, and the second portions 118 are interconnected to one of the swing arms 34 of the second clamp assembly 18.

The pistons 106 create a seal with the housings 110, and the hydraulic circuit 98 provides hydraulic fluid to the pulling cylinders 102 to move the pistons 106 in an extend direction or a retract direction with respect to the housings 110 to lengthen or shorten the pulling members 26. The length of the pulling members 26 determines the distance between the outer joints 46 of the first clamp assembly 14 and the outer joints 46 of the second clamp assembly 18. Shortening the pulling members 26 decreases the distance between the outer joints 46, and lengthening the pulling members 26 increases the distance between the outer joints 46. As described below, when the clamp assemblies 14, 18 engage the rail sections, retracting the pulling cylinders 102 and shortening the pulling members 26 draws the clamp assemblies 14, 18 closer to one another and reduces the gap between rail sections. The pulling cylinders 102 usually operate together in unison.

As shown in FIG. 6, the hydraulic circuit 98 directs hydraulic fluid to extend or retract the clamping cylinder 78 and the pulling cylinders 102. In the illustrated embodiment, the hydraulic circuit 90 includes a power source 122, a pump 124, a controller 126, an advance circuit 130, and a retract circuit 134. The power source 122 is a reservoir that provides hydraulic fluid for the hydraulic circuit 90. The pump generates fluid flow through the hydraulic circuit 98. The controller 126 is a valve that controls the flow of hydraulic fluid from the power source 122 to the advance circuit 130 or retract circuit 134. The controller 126 generally has three settings: an extend or advance setting, a retract or pull setting, and a neutral setting. The advance circuit 130 extends or advances the clamping cylinder 78 and pulling cylinders 102 to lengthen the clamping beam 22 and pulling members 26 respectively. The retract circuit 134 retracts or pulls the clamping cylinder 78 and pulling cylinders 102 to shorten the clamping beam 22 and pulling members 26 respectively. The hydraulic circuit 98 also includes at least one shut-off valve 138 to control the flow of hydraulic fluid to the clamping cylinder 78 and the pulling cylinders 102.

In the illustrated embodiment, the clamping cylinder 78 and pulling cylinders 102 are hydraulic cylinders, and the hydraulic circuit 98 is used to control the rail puller 10. Alternatively, a pneumatic system, or other similar actuating devices could be used to actuate the clamping beam 22 and pulling members 26 to reduce the gap between rail sections.

The rail puller 10 reduces the gap between the ends of rail sections. In order to reduce the gap, the clamp assemblies 14, 18 clamp the rail sections, and the clamp assemblies 14, 18 are then drawn closer together to pull the rail sections closer together. Generally, the clamping beam 22 is used to clamp the clamp assemblies 14, 18 onto the rail sections, and the pulling members 26 are used to pull the clamp assemblies 14, 18 and rail sections together.

Some prior art rail pullers have a single set of pulling cylinders that clamp the rail sections, as well as draw the rail sections together. Two important features of hydraulic cylinders are the pulling capacity and the travel distance of the cylinder. Hydraulic cylinders generally comprise a piston enclosed within a housing. The pulling capacity of the cylinder generally represents the amount of force the cylinder can generate, and is related to the diameter of the cylinder and the surface area of the piston in the cylinder. The travel distance of the cylinder generally represents the overall range and length of the cylinder, and is the distance between the fully retracted cylinder and the fully extended cylinder. The travel distance is related to the length of the housing. Generally, as the pulling capacity and travel distance of a cylinder increases, the weight and the cost of the cylinder also increase.

The force required to draw the rail sections together is significantly greater than the force required to initiate the clamping of the rail sections. In the illustrated embodiment, the clamping cylinder 78 clamps the rail sections, and the pulling cylinders 102 draw the rail sections together. The pulling cylinders 102 have a pulling capacity significantly greater than the pulling capacity of the clamping cylinder 78. In the illustrated embodiment, the clamping cylinder 78 is a double acting hydraulic cylinder with a capacity of approximately 10 tons on the extend or push side and approximately 4 tons on the pull side, and a travel distance of approximately 10 inches. The pulling cylinders 102 are double acting hydraulic cylinders with a capacity of approximately 60 tons on the pull side, and a travel distance of approximately 6 inches.

The rail puller 10 uses the relatively smaller capacity clamping cylinder 78 to set and clamp the rail sections and reduce the necessary travel distance of the relatively larger capacity pulling cylinders 102. Since the length of the larger pull capacity pulling cylinders 102 is decreased, the weight and cost of the pulling cylinders 102 are also decreased.

The required travel path for cylinders of a rail puller can generally be divided into a clamping path and a pulling path. For example, in some prior art rail pullers having only pulling cylinders, the pulling cylinders travel a clamping path of approximately 10 inches, and a pulling path of approximately 6 inches. Therefore, each pulling cylinder would require a total travel distance of approximately 16 inches.

In the illustrated embodiment, a single clamping cylinder 78 is used to clamp the rail sections and actuate the rail puller 10 through the clamping path which requires a relatively smaller force. The pulling cylinders 102 are only needed for the pulling path, which requires a relatively larger force in comparison to the clamping path. Therefore, in the illustrated embodiment, the travel distance of the pulling cylinders 102 may be reduced from the travel distance of prior art pulling cylinders. Using the previous example, the travel distance could be reduced approximately 10 inches. The reduction in travel distance of the pulling cylinders 102 reduces the weight and cost of the rail puller 10.

As shown in FIG. 6, the clamping cylinder 78 has a smaller diameter than the pulling cylinder 102, and the piston 82 of the clamping cylinder 78 has a smaller exposed surface area than the pistons 106 of the pulling cylinders 102. As mentioned-above, capacity is related to the diameter and exposed surface area of the pistons 82, 106. The capacity of the clamping cylinder 78 is significantly less than the capacity of the pulling cylinders 102. The weight and cost savings from reducing the travel distance of the pulling cylinders 102 is significantly larger than the additional weight and cost-of the clamping cylinder 78. Therefore, the overall weight and cost of the rail puller 10 is less than the weight and cost of some prior art rail pullers.

Figure 2:
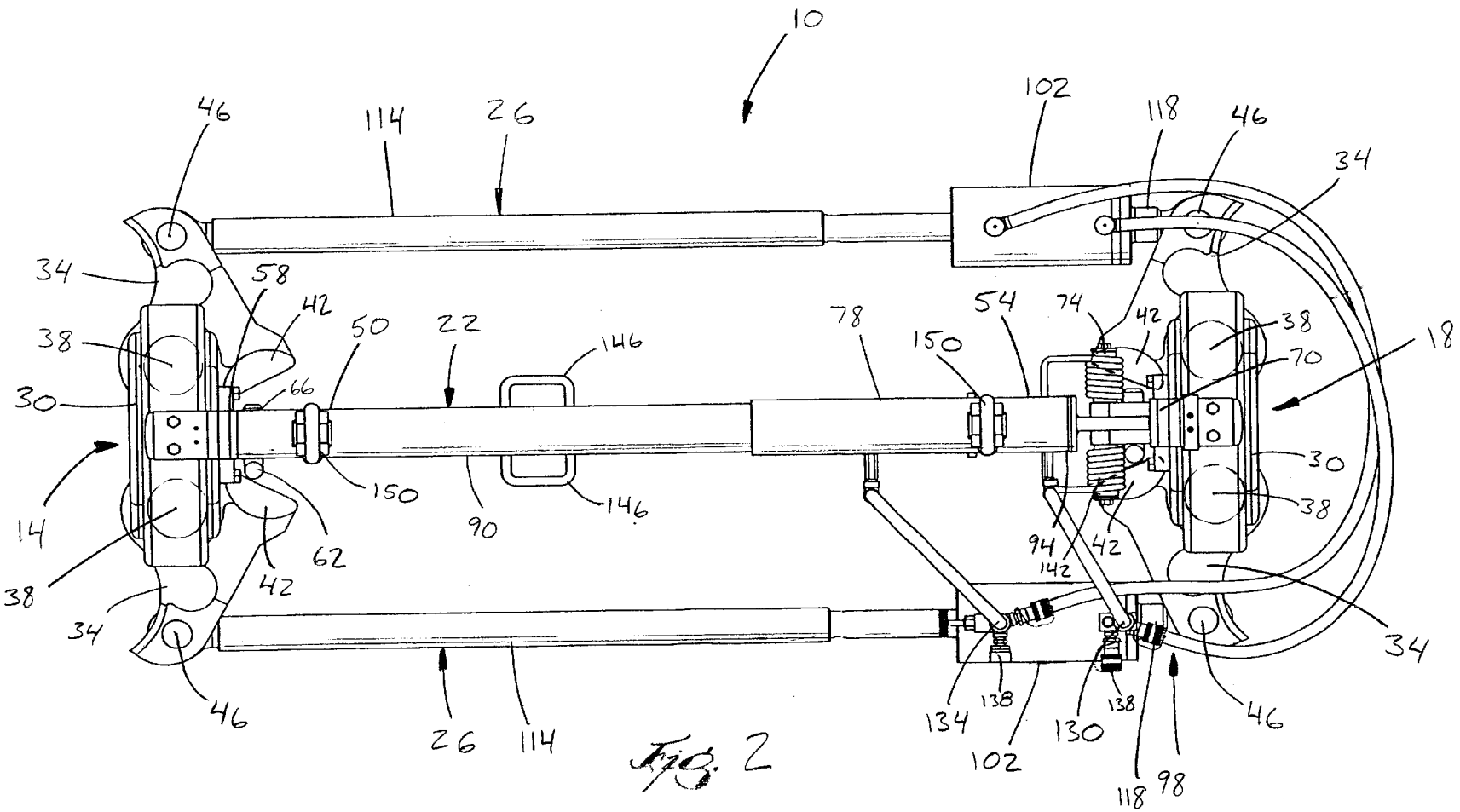
FIG. 2 is a plan view of the rail puller of FIG. 1 in an open condition.
Figure 3:
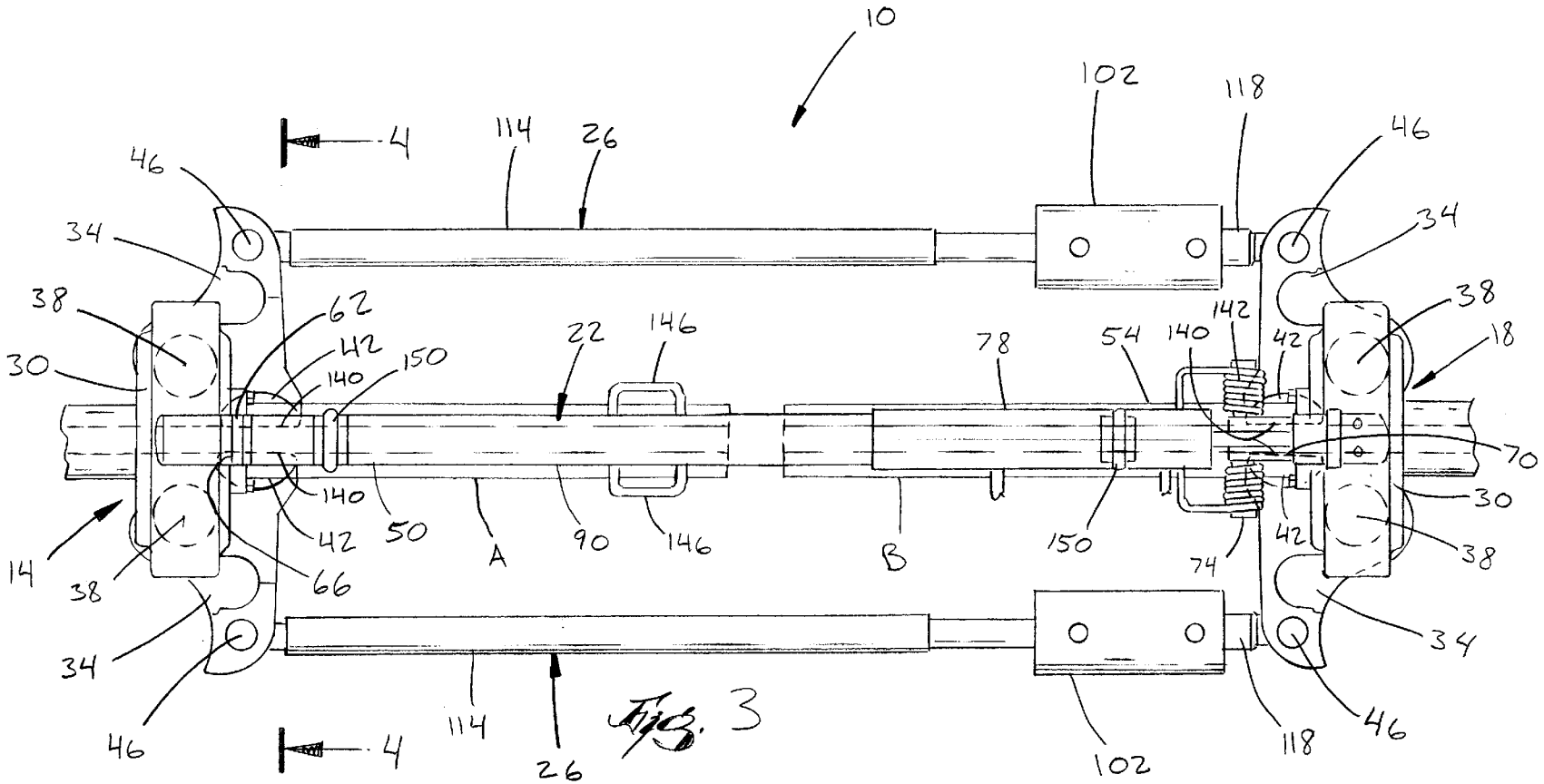
FIG. 3 is a plan view of the rail puller of FIG. 1 in a closed condition.

The rail puller 10 is movable between an open condition and a closed condition. FIGS. 1, 3 and 4 illustrate the rail puller 10 in the open condition, and FIGS. 2 and 6 illustrate the rail puller 10 in the closed condition. When the rail puller 10 is in the open condition, as shown in FIG. 2, the grips 42 are pivoted away from one another, and away from the rail sections. In the open condition, the clamping cylinder 78 is retracted, and the pulling cylinders 102 are extended. The clamping cylinder 78 extends to move the rail puller 10 from the open condition to the closed condition.

FIG. 6 illustrates the rail puller 10 in the open condition with the hydraulic circuit 98. As mentioned above, the hydraulic circuit 98 includes the advance circuit 130 that extends the cylinders 78, 102, the retract circuit 134 that retracts the cylinders, and shut-off valves 138 that restrict the flow through the hydraulic circuit 98. To move the rail puller 10 to the closed condition, the controller 126 is adjusted to permit flow through the advance circuit 130 and extend the cylinders 78, 102. Since the pulling cylinders 102 are already extended, they will remain extended while the clamping cylinder 78 also extends.

As the clamping cylinder 78 extends, the clamping beam 22 increases in length and the clamp brackets 30 move away from one another in a longitudinally outward direction. The clamp brackets 30,and the inner joints 38 of the respective clamp assemblies 14, 18 move away from one another, but the distance between the outer joints 46 of the respective clamp assemblies 14, 18 remains substantially the same, which causes the swing arms 34 to pivot. The pivoting swing arms 34 move the grips 42 laterally inward toward the rail sections. As the swing arms 34 continue to pivot, the grips 42 engage the rail sections, and the clamp assemblies 14, 18 clamp the rail sections.

Once the clamping cylinder 78 is extended and the clamp assemblies 14, 18 clamp the rail sections, the rail puller 10 is in the closed condition. FIG. 3 illustrates the rail puller 10 in the closed condition clamping a first rail section A and a second rail section B. The first clamp assembly 14 clamps the first rail section A, and the second clamp assembly 18 clamps the second rail section B. In the illustrated embodiment, the grips 42 are pivotally coupled to the swing arms 34 to ensure that an engaging surface 140 properly aligns with the rail sections A, B. The grips 42 pivot with respect to the swing arms 34 to maximize contact between the engaging surface 140 and the rail sections A, B as the swing arms 34 pivot to the clamped closed condition. The pivoting grips 42 permit the clamp assemblies 14, 18 to properly clamp rail sections of varying widths, and prevents uneven wear of the engaging surface 140. FIG. 4 illustrates the first clamp assembly 14 in the closed condition clamping the rail section A with the engaging surfaces 140 of the grips 42 contacting the rail section A.

The swing arms 34 are opposed and rotate toward each other when pulling force is applied to the pulling members 26 by the pulling cylinders 102. The clamping force developed by the clamp assemblies 14, 18 is a ratio of the pulling force applied by the pulling cylinders 102 and is dependent on the ratio of the distance from the center line of the grips 42, to the center line of the inner joints 38, and the distance from the center line of the outer joints 46 to the center line of the inner joints 38. The ratio can be varied as required to insure sufficient clamping pressure on the grips 42 to make them bite and hold the rail sections A and B.

In FIG. 6, the hydraulic circuit 98 includes a priority valve 160 to control the extend sequence of the pulling cylinders 102 and the clamping cylinder 78 such that the pulling cylinders 102 always extend to their maximum travel before the clamping cylinder 78 extends the beam 22 to close the clamp assemblies 14, 18. The priority valve 160 also includes spring biased check valves 164, 168 to provide a resistance to flow in and out of the extend port of clamping cylinder 78. The resistance to flow provided by valve 164 of priority valve 160 insures full extension of the pulling cylinders 102 before extension of cylinder 78 of beam 22 to close the clamp assemblies 14, 18. The resistance to flow provided by valve 168 of priority valve 160 requires the retract circuit 134 to build and maintain sufficient pressure in the pulling cylinders 102 to keep the clamp assemblies 14, 18 closed on the rail sections A and B while retracting the beam 22.

In FIG. 3, after the clamp assemblies 14, 18 clamp the respective rail sections A, B, the lock pin 62 may be removed from the detachable end 50 to unlock the clamping beam 22 from the first clamp assembly 14; In the illustrated embodiment, the clamping cylinder 78 has a smaller cross-sectional area than the pulling cylinders 102, and travels at a faster rate than the pulling cylinders 102. Therefore, the clamping beam 78 is disengaged from the first clamp assembly 14 to prevent the clamp brackets 30 and the inner joints 38 from moving longitudinally inward at a faster rate than the outer joints 46, which could cause the swings arms 34 to pivot the grips 42 outward and disengage the rail sections A, B. Removing the lock pin 62 ensures that the clamp assemblies 14, 18 will not unclamp from the rail sections A, B while the rail puller 10 is pulling the rail sections A, B.

To pull the rail sections using the hydraulic circuit 98 shown in FIG. 6, the controller 126 is switched to a pull position and fluid flows into the retract circuit 134 to retract the cylinders 78, 102. The hydraulic circuit of beam 22 is protected by the priority valve 160 to limit the loading and control the retraction of the beam 22. The spring biased valve 168 provides resistance to close the beam 22. After the pin 62 is removed from the beam 22, the priority valve 160 will force the puller 10 to first try to pull the rail before the beam 22 can disconnect from the clamp assemblies 14, 18. This action helps the puller 10 set itself on the rail before the beam 22 retracts. Once the beam 22 retracts, the full operating pressure of the hydraulic circuit 98 can be supplied to the pulling cylinders 102 to develop the force required to pull the rail. By maintaining the initial clamping pressure, the priority valve 160 insures that the beam 22 retracts before the pulling cylinders 102.

The hydraulic pressure required to pull the rail sections A and B together is greater than the pressure required to retract the clamping cylinder 78 of beam 22. The lock pin 62 is removed to disconnect the clamping beam 22 from the first clamp assembly 14. The retracting pulling cylinders 102 pull the clamp assemblies 14, 18 toward one another. The pulling cylinders 102 generally operate in unison to pull the rail sections together. Since the clamp assemblies 14, 18 are clamped onto the rail sections A, B, the retracting pulling cylinders 102 also pull the rail sections A, B toward one another and reduce the gap between the rail sections A, B.

Figure 5:
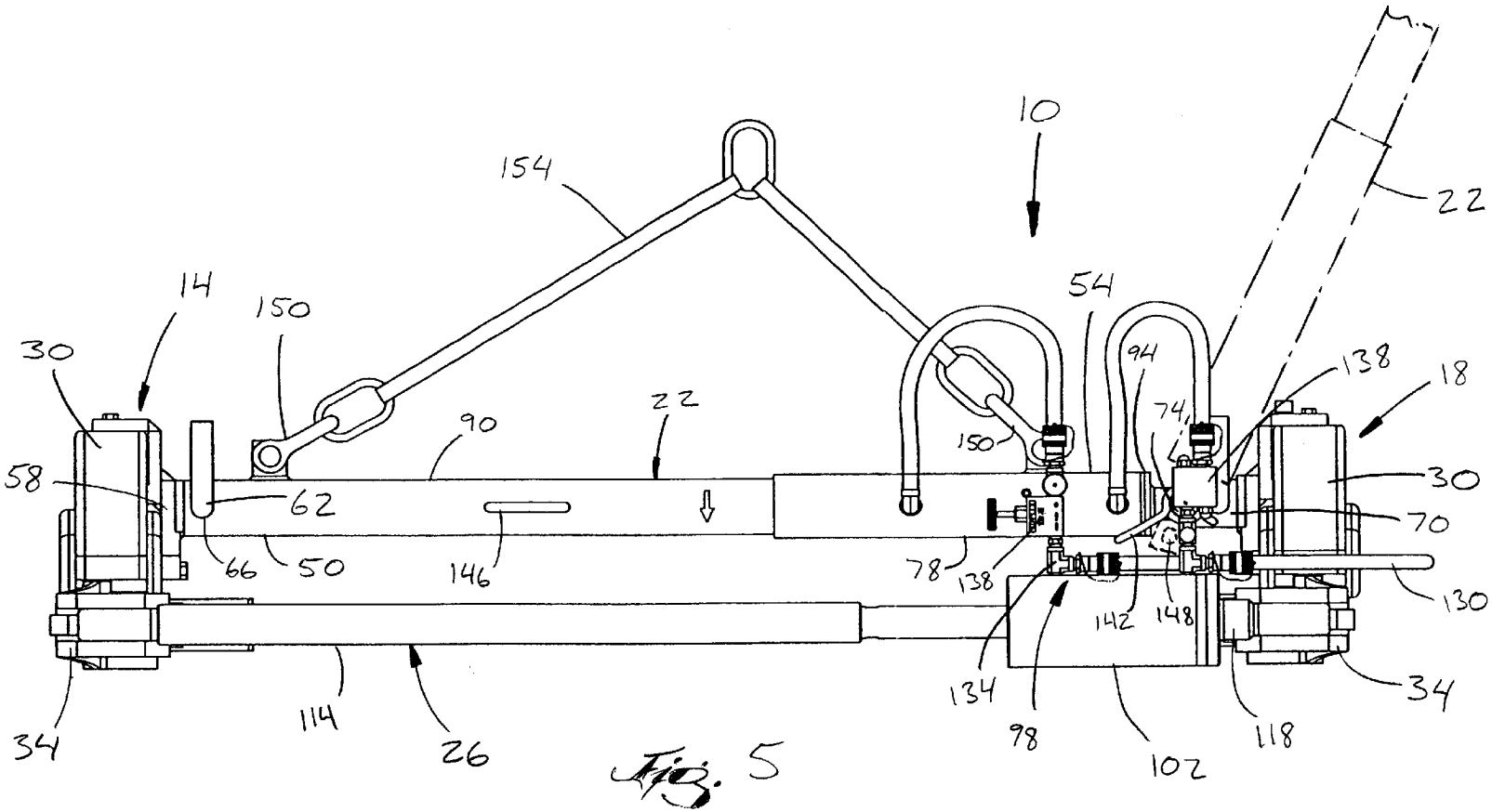
FIG. 5 is an elevation view of the rail puller of FIG. 1.

After the clamping beam 22 is retracted and the rail sections are pulled together, the clamping beam 22 may be pivoted upwardly about the pivot pin 74 to provide clearance for welding the rail sections together. FIG. 5 illustrates the clamping beam 22 in the substantially horizontal position coupled to the first clamp assembly 14. The dashed lines of FIG. 5 illustrate the clamping beam 22 in the upward pivoted position. With the clamping beam 22 pivoted upward, there is additional clearance near the middle of the rail puller 10 to provide a clear workspace for welding the rail sections together.

A spring 142 biases the clamping beam 22 toward the pivoted position to reduce the amount of effort required to lift and pivot the clamping beam 22. In the illustrated embodiment, the spring 142 does not provide enough force to lift the clamping beam 22 independently, but it does provide assistance for lifting and pivoting the clamping beam 22. The clamping beam 22 also includes handles 146 along the sides of clamping beam 22 to help a person lift and pivot the clamping beam 22. After the clamping beam 22 is pivoted upward, the lock pin 62 may be inserted into a retaining hole 148 at the pivot end 54 near the pivot pin 74. The lock pin 62 in the retaining hole 148 prevents the clamping beam 22 from unexpectedly pivoting downwardly before the welding activities are completed.

The cylinders 78, 102 may be located at any position along the clamping beam 22 and pulling members 26. In the illustrated embodiment, the clamping cylinder 78 is located near the pivot pin 74 and the second clamp assembly 18. Since the clamping cylinder 78 generally weighs more than the remaining portion of the clamping beam 22, locating the clamping cylinder 78 near the pivot end 54 lowers the center of gravity of the clamping beam 22 as it pivots and reduces the amount of effort required to pivot the clamping beam 22 upward. Additionally, the pulling cylinders 102 are located near second clamp assembly 18 to minimize the amount of piping or hoses required for the hydraulic circuit 98 to connect the pulling cylinders 102 and clamping cylinder 78.

After the ends of the rail sections are welded together, the rail puller 10 is moved to the open condition and removed from the rail sections. First, the controller 126 (FIG. 6) is moved to the extend position to release the clamping pressure. Next, the lock pin 62 is removed from the retaining hole 148 and the clamping beam 22 is pivoted downwardly. The clamping cylinder 78 is extended until the clamping beam 22 can reengage with the first clamp assembly 14 and the lock pin 62 is inserted through the lock holes 66 to couple the detachable end 50 to the mounting bracket 58.

The pulling cylinders 102 continue to extend until they reach the maximum extended travel. After the pulling cylinders 102 are extended, the shut-off valves 138 are closed to prevent flow to the pulling cylinders 102, and the controller 126 (FIG. 6) is moved to the retract position. The clamping cylinder 78 retracts to shorten the clamping beam 22 and move the clamp brackets 30 toward one another. As the clamp brackets 30 and inner joints 38 move longitudinally inward, the pulling members 26 maintain their length because the shut-off valves 138 prevent the retract circuit 134 from retracting the pulling cylinders 102. The distance between the outer joints 46 of the first clamp assembly 14 and the outer joints 46 of the second clamp assembly 18 remains substantially the same. The movement of the inner joints 38 with respect to the outer joints 46 causes the swing arms 34 to pivot and move the grips 42 laterally outward and away from the rail sections. After the clamping cylinder 78 is retracted, the rail puller 10 is once again in the open condition.

As shown in FIG. 5, the rail puller 10 has hooks 150 on the clamping beam 22 to facilitate removing the rail puller 10 from the rail sections. A sling 154 is connected to the hooks 150 to help lift the rail puller 10. The lock pin 62 is inserted through the lock holes 66 before the rail puller 10 is lifted. A crane, hoist, pulley system or other similar lifting device may be attached to the sling to lift the rail puller 10 and remove the rail puller 10 from the rail sections.

Figure 7:
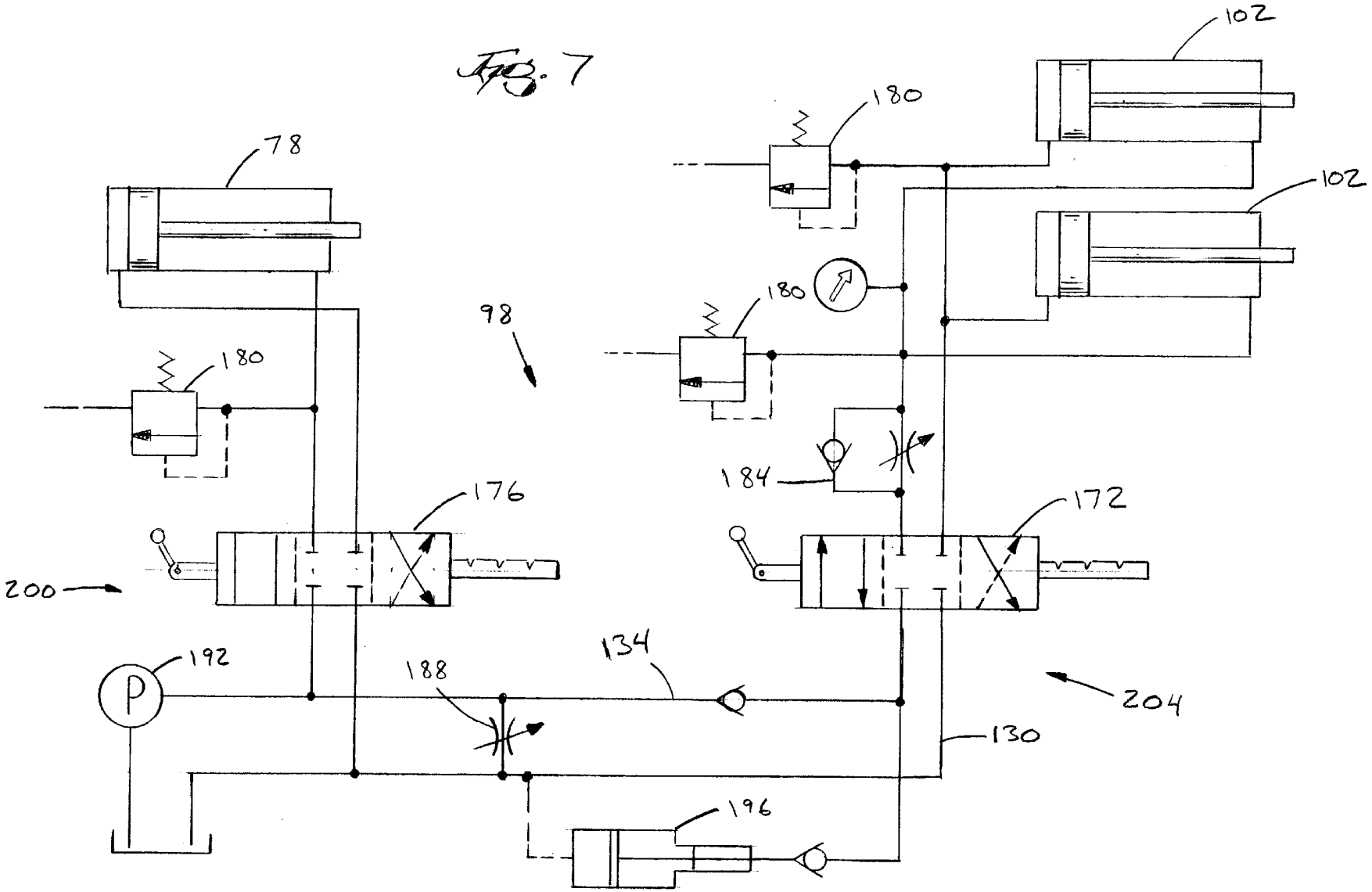
FIG. 7 is a schematic of a hydraulic circuit for the rail puller of FIG. 1.

FIG. 7 illustrates an additional embodiment of the hydraulic circuit 98 having an advance circuit 130 and retract circuit 134. The hydraulic circuit 98 includes a pull control valve 172 that controls the pulling cylinders 102, and a beam control valve 176 that controls the clamping cylinder 78. The control valves 172, 176 may be used to operate the cylinders 78, 102 independently. The hydraulic circuit 98 also includes at least one relief valve 180. In the illustrated embodiment, each cylinder 78, 102 is in fluid flow communication with a relief valve 180. The hydraulic circuit 98 also includes a load lock valve 184 and a speed control valve 188. The load lock valve 184 may include a needle valve to regulate flow in a first direction and a check valve to regulate flow in a second direction. The speed control valve 188 regulates the speed of fluid flow through the hydraulic circuit 98 and may include a needle valve.

In FIG. 7, the hydraulic circuit 98 includes a power connection 192 that may be connected to a power take off unit (PTO) on a railway vehicle or other power source. Railway vehicles commonly include a PTO to provide power, such as hydraulic power, for auxiliary equipment, such as a rail puller. In the illustrated embodiment, the PTO may provide hydraulic flow to the hydraulic circuit 98 at approximately 5 to 10 GPM (gallons per minute) and 2000 PSI (pounds per square inch).

A hydraulic booster 196 may increase the pressure of the hydraulic flow through at least a portion of the hydraulic circuit 98. The hydraulic booster 196 may increase the pressure of the 5–10 GPM at 2000 PSI fluid flow to approximately 1–2 GPM at 10,000 PSI. In the illustrated embodiment, the hydraulic circuit 98 may include a low pressure portion 200 having the lower pressure fluid flow input from the PTO, and a high pressure portion 204 having a higher pressure fluid flow from the hydraulic booster 196. In FIG. 7, the beam control valve 176 controls the clamping cylinder 78 on the low pressure portion 200, and the pull control valve 176 controls the pulling cylinders 102 on the high pressure portion 204. The increased pressure on the high pressure portion 204 may be used to generate a higher pulling force in the pulling cylinders 102.

What is claimed is:

1. A rail puller for reducing gap between rail sections, the rail puller comprising:

a first clamp assembly and a second clamp assembly disposed at opposite ends of the rail puller;

an elongated clamping beam coupled to the first clamp assembly and the second clamp assembly, and including a clamping cylinder that is extendable and retractable to adjust the length of the clamping beam, and the clamping cylinder being movable to clamp the first clamp assembly and second clamp assembly to the rail sections; and at least one elongated pulling member coupled to the first clamp assembly and the second clamp assembly, and the at least one elongated pulling member being movable to draw the first clamp assembly and second clamp assembly toward one another to reduce the gap between the rail sections, wherein the at least one elongated pulling member includes a pulling cylinder which is extendable and retractable, and the rail puller is movable between an open condition and a closed condition, the rail puller being in the open condition when the clamping cylinder is retracted and the pulling cylinder is extended, and the rail puller being in the closed condition when the clamping cylinder is extended.

2. The rail puller of claim 1, wherein the rail puller clamps the rail sections when the rail puller is in the closed condition.

3. The rail puller of claim 1, wherein the first clamp assembly and second clamp assembly each comprise:

a clamp bracket coupled to the clamping beam; and a swing arm pivotally coupled to the clamp bracket at an inner joint and pivotally coupled to the pulling member at an outer joint, the swing arm having a grip.

4. The rail puller of claim 3, wherein the grips are pivotally coupled to the swing arms.

5. The rail puller of claim 3, wherein the swings arms pivot with respect to the outer joints when the clamping cylinder extends.

6. The rail puller of claim 1, wherein the clamping cylinder has a travel path greater than the travel path of the pulling cylinder.

7. The rail puller of claim 1, wherein the pulling cylinder has a pull capacity greater than the pull capacity of the clamping cylinder.

8. The rail puller of claim 1, wherein the clamping beam is removably coupled to the first clamp assembly, and pivotally coupled to the second clamp assembly.

9. The rail puller of claim 1, further comprising a hydraulic circuit including;

an advance circuit that extends the clamping cylinder and the pulling cylinder;

a retract circuit that retracts the clamping cylinder and the pulling cylinder;

a controller that controls flow through the hydraulic circuit; and at least one shut-off valve that restricts flow to the pulling cylinder when the shut-off valve is closed.

10. The rail puller of claim 9 where the hydraulic circuit includes a priority valve to control the sequence of operation between the clamping cylinder and the pulling cylinder.

11. The rail puller-of claim 1, further comprising a hydraulic circuit including:

a power source generating a fluid flow through the hydraulic circuit;

a first portion having a first fluid flow;

a second portion having a second fluid flow, and the pressure of the second fluid flow is greater than the pressure of the first fluid flow; and a hydraulic booster that increases the pressure of the first fluid flow in the first portion to the pressure of the second fluid flow in the second portion.

12. The rail puller of claim 11, further comprising a beam control valve controlling the clamping cylinder, wherein the beam control valve is in fluid flow communication with the first portion.

13. The rail puller of claim 11, further comprising a pull control valve controlling the pulling cylinder, wherein the pulling cylinder is interconnected to the pulling member, and the pull control valve is in fluid flow communication with the second portion.

14. A rail puller for reducing gap between rail sections, the rail puller comprising:

a first clamp assembly and a second clamp assembly disposed at opposite ends of the rail puller, each clamp assembly including a clamp bracket and at least two swing arms pivotally coupled to the clamp bracket at an inner joint;

an elongated clamping beam coupled to the first clamp assembly and the second clamp assembly, and having a clamping cylinder that is extendable and retractable to adjust the length of the clamping beam, each clamp bracket being coupled to an opposite end of the clamping beam from one another;

at least two elongated pulling members coupled to the first clamp assembly and the second clamp assembly, wherein each pulling member has a pulling cylinder that is extendable and retractable to adjust the length of the pulling members, and the ends of each pulling member are pivotally coupled to one of the swing arms at an outer joint;

wherein the swing aims pivot with respect to the outer joints to clamp the rail sections.

15. The rail puller of claim 14, wherein each swing arm includes a grip that is pivotally mounted to the swing arm, and the grips contact the rail sections when the rail puller clamps the rail sections.

16. The rail puller of claim 15, wherein the grips pivot laterally inward and longitudinally outward with respect to the outer joints when the clamping beam extends.

17. The rail puller of claim 14, wherein the clamping cylinder extends to clamp the first clamp assembly and second clamp assembly to rail sections, and the pulling cylinders retract to draw the first clamp assembly and second clamp assembly toward one another and reduce the gap between the rail sections.

18. The rail puller of claim 14, wherein the rail puller is movable between an open condition and a closed condition, and the rail puller is in the open condition when the clamping cylinder is retracted and the pulling cylinders are extended, and the rail puller is in the closed condition when the clamping cylinder is extended.

19. The rail puller of claim 18, wherein the rail puller clamps the rail sections when the rail puller is in the closed condition.

20. The rail puller of claim 14, wherein the clamping cylinder has a travel path greater than the travel path of the pulling cylinders.

21. The rail puller of claim 14, wherein the pulling cylinders have a pull capacity greater than the pull capacity of the clamping cylinder.

22. The rail puller of claim 14, wherein the clamping beam is removably coupled to the first clamp assembly, and pivotally coupled to the second clamp assembly.

23. The rail puller of claim 14, further comprising a hydraulic circuit including an advance circuit that extends the clamping cylinder and pulling cylinders;

a retract circuit that retracts the clamping cylinder and pulling cylinders;

a controller that controls flow through the hydraulic circuit; and at least one shut-off valve that restricts flow to the pulling cylinders when the shut-off valve is closed.

24. The rail puller of claim 23 where the hydraulic circuit includes a priority valve to control the sequence of operation between the clamping cylinder and the pulling cylinder.

25. The rail puller of claim 14, further comprising a hydraulic circuit including:

a power source generating a fluid flow through the hydraulic circuit;

a first portion having a first fluid flow;

a second portion having a second fluid flow, and the pressure of the second fluid flow is greater than the pressure of the first fluid flow; and a hydraulic booster that increases the pressure of the first fluid flow in the first portion to the pressure of the second fluid flow in the second portion.

26. The rail puller of claim 25, further comprising a beam control valve controlling the clamping cylinder, wherein the beam control valve is in fluid flow communication with the first portion.

27. The rail puller of claim 25, further comprising a pull control valve controlling a pulling cylinder, wherein the pulling cylinder is interconnected to the pulling member, and the pull control valve is in fluid flow communication with the second portion.

28. A method for reducing a gap between rails comprising: providing a rail puller including:

a first clamp assembly and a second clamp assembly disposed at opposite ends of the rail puller;

a clamping beam coupled to the first clamp assembly and the second clamp assembly, and including a clamping cylinder; and at least two pulling members coupled to the first clamp assembly and the second clamp assembly, each pulling member including a pulling cylinder, wherein the pulling members are on opposite sides of the clamping beam;

positioning the rail puller near the rails with the clamp assemblies on opposite sides of the gap;

extending the clamping cylinder to move the clamp assemblies away from one another and engage the clamp assemblies with the rails; and retracting the pulling cylinders to move the clamp assemblies toward one another and reduce the gap between the rails.

29. The method of claim 28, wherein the clamp assemblies each comprise:

a clamp bracket coupled to the clamping beam;

at least two opposing swing arms, wherein each swing arm is pivotally coupled to the clamp bracket at an inner joint, and pivotally coupled to one of the pulling members at an outer joint, each swing arm having a grip disposed between the inner joint and the opposite clamping assembly that engages one:of the rails; and wherein extending the clamping cylinder moves the clamp brackets away from each other, moves the joints in a substantially linear direction, and pivots the swing arms about the outer joints to pivot the grips inwardly and engage one of the rails.

30. The method of claim 28, further comprising disconnecting the clamping beam from the first clamp assembly and pivoting the clamping beam upwardly in relation to the second clamp assembly after the clamping cylinder is extended and before the pulling cylinders are retracted.

31. The method of claim 30, further comprising:

extending the pulling cylinders;

pivoting the clamping beam downwardly in relation to the second clamp assembly and reconnecting the clamping beam to the first clamp assembly;

retracting the clamping cylinder to move the clamp assemblies toward one another and disengage the clamp assemblies from the rails; and removing the rail puller from the rails.

32. A rail puller for reducing a gap between rail sections, the rail puller comprising:

clamping beam having a first end, a second end opposite the first end, and a clamping cylinder being extendable and retractable to adjust the length of the clamping beam;

a first clamp assembly coupled to the first end of the clamping beam and a second clamp assembly coupled to the second end of the clamping beam; and at least one pulling member coupled to the first and second clamp assemblies and having a pulling cylinder being extendable and retractable to adjust the length of the pulling member, the first and second clamp assemblies each being movable between an open condition, in which the clamping cylinder is retracted and the pulling cylinder is extended, and a closed condition, in which the clamping cylinder is extended and the first and second clamp assemblies engage the rail sections.

33. The rail puller of claim 32, wherein the at least one pulling member is retractable to draw the first and second clamp assemblies toward one another to reduce the gap between the rail sections when the first and second clamp assemblies are in the closed condition.

* * * * *